US007471917B2

(12) United States Patent
Hiroe et al.

(10) Patent No.: US 7,471,917 B2
(45) Date of Patent: Dec. 30, 2008

(54) IMAGE FORMING APPARATUS WITH CONVEYANCE UNIT REGULATING STRUCTURE

(75) Inventors: Nobuhiro Hiroe, Saitama (JP); Noribumi Sato, Saitama (JP); Yoshishige Sakamoto, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 196 days.

(21) Appl. No.: 11/302,223

(22) Filed: Dec. 14, 2005

(65) Prior Publication Data

US 2006/0291901 A1 Dec. 28, 2006

(30) Foreign Application Priority Data

Jun. 23, 2005 (JP) ..... 2005-183401

(51) Int. Cl.
*G03G 15/01* (2006.01)

(52) U.S. Cl. ..... 399/121

(58) Field of Classification Search ..... 399/121, 399/107

See application file for complete search history.

(56) References Cited

U.S. PATENT DOCUMENTS 5,342,033 A * 8/1994 Iwata et al. ..... 270/58.08
6,343,198 B1 * 1/2002 Sato ..... 399/121
6,950,619 B2 * 9/2005 Sunohara ..... 399/124
2005/0036804 A1 * 2/2005 Yokoi ..... 399/124
2005/0147432 A1 * 7/2005 Miura et al. ..... 399/250

FOREIGN PATENT DOCUMENTS

JP 11153893 A * 6/1999
JP 2001-201982 A 7/2001

* cited by examiner

*Primary Examiner*—Quana M Grainger
(74) *Attorney, Agent, or Firm*—Oliff & Berridge, PLC

(57) ABSTRACT

An image forming apparatus including: a conveyance unit including a belt member stretched across at least a drive roller and a driven roller and conveys a recording medium and a casing that axially supports the drive roller and the driven roller; a body frame disposed with an image carrier for transferring an image to the recording medium; and a cover to which the conveyance unit is attached, is pivotably attached to the body frame, and opens/closes off the image carrier. A first regulating portion against which an annular member placed on a shaft portion of the drive roller abuts when the cover pivots toward the body frame to close off the image carrier and a second regulating portion with which an engagement portion formed in the casing in a direction orthogonal to the axial direction of the drive roller engages are formed on the body frame.

21 Claims, 9 Drawing Sheets

IMAGE FORMING APPARATUS WITH CONVEYANCE UNIT REGULATING STRUCTURE

CROSS-REFERENCE TO RELATED APPLICATION

This application claims priority under 35 USC 119 from Japanese Patent Application No. 2005-183401, the disclosure of which is incorporated by reference herein.

BACKGROUND OF THE INVENTION

1. Field of the Invention

The present invention relates to an image forming apparatus where a cover is pivotably attached to a body frame and where a conveyance unit that conveys a recording medium and an intermediate transfer belt to which an image is transferred from a photosensitive body (image carrier) are attached to the cover.

2. Description of the Related Art

Conventionally, image forming apparatus have been known where a toner image formed on a photosensitive body (image carrier) or an intermediate transfer belt (belt member) is transferred/fixed to recording paper (a recording medium) to form an image. Among such image forming apparatus, there are image forming apparatus where a cover is pivotably attached to a body frame disposed with the photosensitive body or the intermediate transfer belt, and where the photosensitive body or the intermediate transfer belt is exposed by opening the cover (e.g., see Japanese Patent Application Publication (JP-A) No. 2001-201982).

Sometimes, a conveyance unit including a conveyor belt that conveys the recording paper is attached to the cover. In such cases, there is the advantage that even if a paper jam occurs while the recording paper is being conveyed, the recording paper causing the paper jam can be easily removed by opening the cover.

However, there is also the problem that when the image forming apparatus is configured in this manner, the conveyance unit (conveyor belt) becomes displaced in the main scanning direction (width direction of the conveyor belt) while the conveyor belt is traveling due to rattling of the cover with respect to the body frame (particularly rattling in the width direction of the conveyor belt). If such positional displacement occurs during printing in full color, the conveyance position of the recording paper shifts slightly per color; thus, there is the drawback that displacement occurs in the color registration. This drawback is also common to image forming apparatus where the intermediate transfer belt is attached to the cover.

SUMMARY OF THE INVENTION

The present invention has been made in view of the above circumstances and provides an image forming apparatus that can ensure that positional displacement of the conveyance unit or the intermediate transfer unit does not occur, even in a configuration where a cover is pivotably attached to a body frame and where a conveyance unit that conveys a recording medium or an intermediate transfer unit to which an image is transferred from an image carrier is attached to the cover.

A first aspect of the invention provides an image forming apparatus including: a conveyance unit including a belt member, which is stretched across at least a drive roller and a driven roller and conveys a recording medium, and a casing that axially supports the drive roller and the driven roller; a body frame disposed with an image carrier for transferring an image to the recording medium; and a cover to which the conveyance unit is attached, is pivotably attached to the body frame, and opens/closes off the image carrier, wherein a first regulating portion against which an annular member placed on a shaft portion of the drive roller abuts when the cover pivots toward the body frame to close off the image carrier and a second regulating portion with which an engagement portion formed in the casing in a direction orthogonal to the axial direction of the drive roller engages are formed on the body frame.

According to the first aspect of the invention, the position of the conveyance unit in the direction orthogonal to the axial direction is regulated by the first regulating portion, and the position of the conveyance unit in the axial direction is regulated by the second regulating portion. Consequently, positional displacement of the conveyance unit disposed on the cover can be appropriately suppressed even when the user pushes on the cover or when something collides with the cover during printing, for example.

A second aspect of the invention provides an image forming apparatus including: an intermediate transfer unit including a belt member, which is stretched across at least a drive roller and a driven roller and onto which an image is transferred from an image carrier, and a casing that axially supports the drive roller and the driven roller; a body frame disposed with the image carrier; and a cover to which the intermediate transfer unit is attached, is pivotably attached to the body frame, and opens/closes off the image carrier, wherein a first regulating portion against which an annular member placed on a shaft portion of the drive roller abuts when the cover pivots toward the body frame to close off the image carrier and a second regulating portion with which an engagement portion formed in the casing in a direction orthogonal to the axial direction of the drive roller engages are formed on the body frame.

According to the second aspect of the invention, the position of the intermediate transfer unit in the direction orthogonal to the axial direction is regulated by the first regulating portion, and the position of the intermediate transfer unit in the axial direction is regulated by the second regulating portion. Consequently, positional displacement of the intermediate transfer unit disposed on the cover can be appropriately suppressed even when the user pushes on the cover or when something collides with the cover during printing, for example.

As described above, according to the present invention, an image forming apparatus can be provided which can ensure that positional displacement of the conveyance unit or the intermediate transfer unit does not occur, even in a configuration where a cover is pivotably attached to a body frame and where a conveyance unit that conveys a recording medium or an intermediate transfer unit to which an image is transferred from an image carrier is attached to the cover.

BRIEF DESCRIPTION OF THE DRAWINGS

A preferred embodiment of the present invention will be described in detail based on the following figures, wherein.

DETAILED DESCRIPTION OF THE INVENTION

Figure 1:
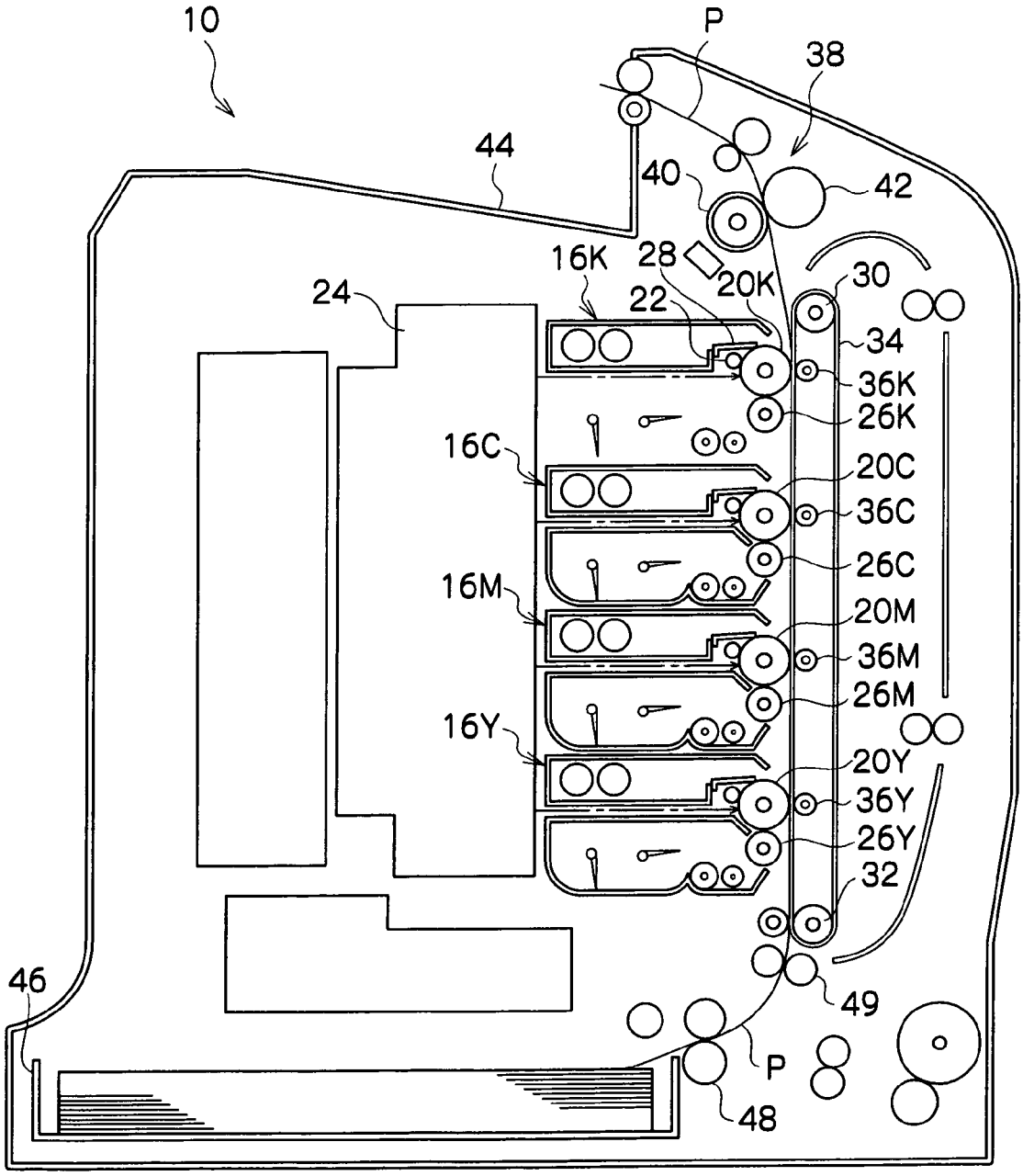
FIG. 1 is a schematic side view showing the configuration of an image forming apparatus pertaining to the embodiment of the invention.

An embodiment of the invention will be described in detailed below on the basis of examples shown in the drawings. In the drawings, sometimes the letters "Y," "M," "C" and "K" are added at the end of reference numerals in regard to elements disposed for the respective colors of yellow (Y), magenta (M), cyan (C) and black (K).

Figure 2:
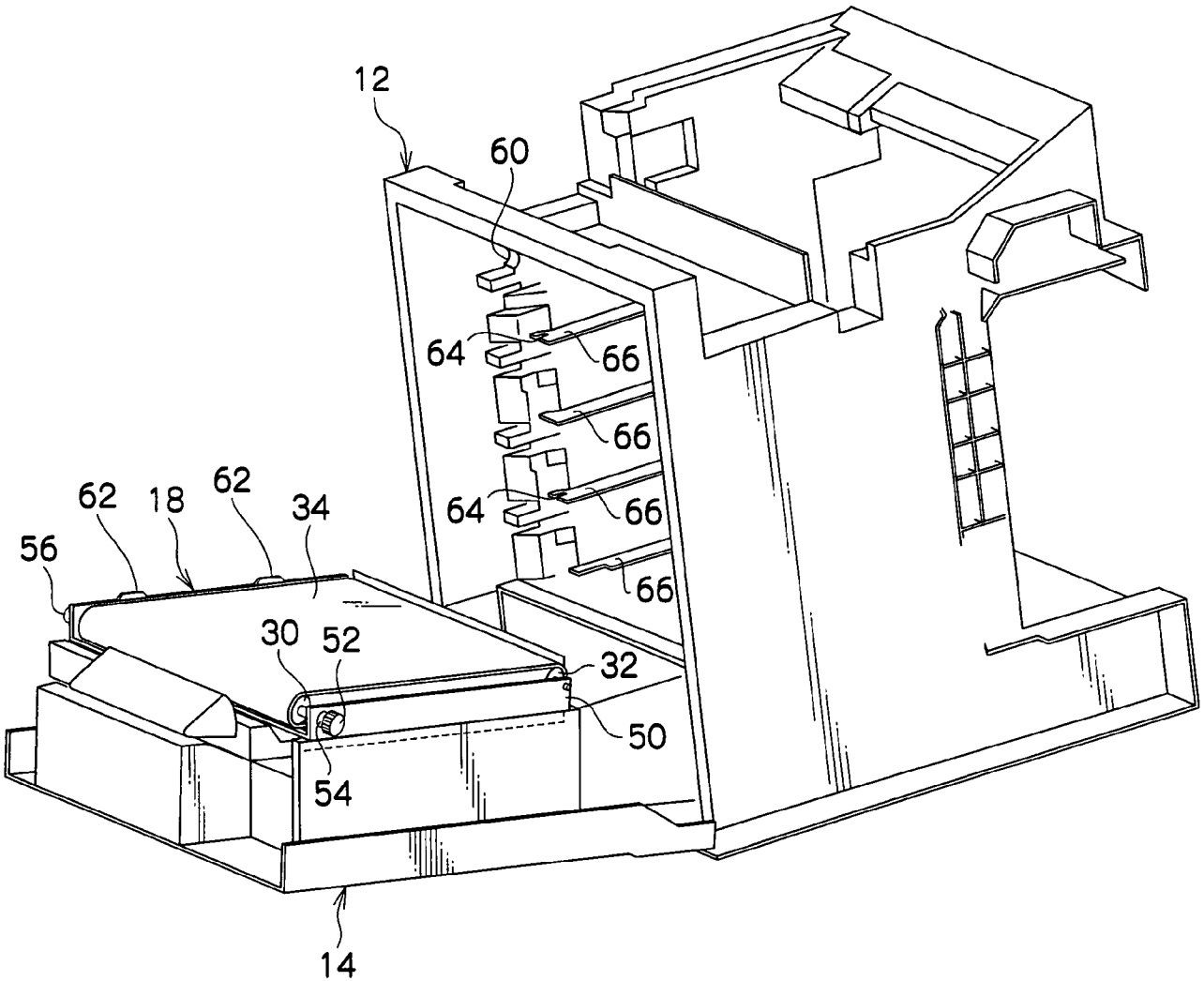
FIG. 2 is a schematic perspective view showing a body frame and a cover to which a conveyance unit is attached.

First, the overall configuration of an image forming apparatus 10 pertaining to the invention will be described. As shown in FIGS. 1 and 2, the image forming apparatus 10 includes a body frame 12, which detachably houses image carriers (photosensitive bodies) 20 and development units 16, and a cover 14, which opens and closes off the image carriers 20 and the development units 16. A conveyance unit 18 disposed with a conveyor belt 34 that sucks and conveys recording paper P is detachably attached to the cover 14.

The development units 16 include: a charge roller 22 that uniformly charges the surface of the roll-like image carrier 20; an optical box 24 that irradiates the image carrier 20 with image light on the basis of image data to form a latent image resulting from the difference in electrostatic potential; a development roller 26 that selectively spreads and visualizes toner to the latent image; and a cleaning member 28 that slidingly contacts the image carrier 20 after the toner image has been transferred to the image carrier 20 and cleans any toner remaining on the image carrier 20.

Each image carrier 20 includes a photosensitive layer on its surface (peripheral surface). After the surface (peripheral surface) of the image carrier 20 has been uniformly charged by the charge roller 22, the surface (peripheral surface) of the image carrier 20 is exposed to the laser light (image light) emitted from the optical box 24, and the electric potential of the exposed portion is reduced, whereby an electrostatic latent image (an image) is formed on the surface of the image carrier 20. The charge roller 22 contacts the image carrier 20, a voltage is applied between the charge roller 22 and the image carrier 20, and discharge occurs in the minute gap in the vicinity of the area where the charge roller 22 contacts the image carrier 20, whereby the charge roller 22 substantially uniformly charges the surface (peripheral surface) of the image carrier 20.

The optical box 24 scans the surface (peripheral surface) of the image carrier 20 with blinking laser light to form the electrostatic latent image based on image data on the surface (peripheral surface) of the image carrier 20. The optical box 24 may be configured to include an arrangement of light-emitting elements such as LEDs and cause these to blink on the basis of image data.

The development roller 26 is disposed such that it is proximate to, and faces, the image carrier 20, and a development bias voltage is applied between the development roller 26 and the image carrier 20. Thus, a development bias electric field is formed between the development roller 26 and the image carrier 20, and toner having an electrical charge is spread to the exposed portion on the image carrier 20 to form a visible image.

The conveyance unit 18 includes a conveyor belt 34 that is stretched across at least a drive roller 30 and a driven roller 32. Plural (four, in correspondence to later-described colors) transfer rollers 36 are disposed at predetermined intervals at predetermined positions between the drive roller 30 and the driven roller 32 at the inner surface side of the conveyor belt 34.

When the cover 14 is closed (when the cover 14 pivots toward the body frame 12 to close off the image carriers 20 and the like), the transfer rollers 36 face the image carriers 20 such that the conveyor belt 34 is sandwiched therebetween, and a transfer electric field is formed between the transfer rollers 36 and the image carriers 20, whereby the toner images (unfixed images) on the surfaces of the image carriers 20 are transferred onto the recording paper P, which is sucked and conveyed on the conveyor belt 34.

Here, the development units 16 are vertically disposed in the order (beginning at the bottom) of yellow (Y), magenta (M), cyan (C) and black (K), for example, such that full color printing is possible. A fixing device 38 is disposed downstream (in the upper portion of the body frame 12) of the development units 16Y to 16K in the conveyance direction of the recording paper P.

The fixing device 38 includes a heating roller 40 and a pressure roller 42 whose peripheral surfaces face and contact each other with a predetermined pressure (to form a nip). The unfixed toner images transferred onto the recording paper P are heated and pressured by the heating roller 40 and the pressure roller 42, whereby the toner images are fixed to the recording paper P.

After the toner images have been fixed to the recording paper P as a result of being heated and pressured by the fixing device 38 (the heating roller 40 and the pressure roller 42), the recording paper P is discharged onto a paper discharge tray 44. Then, after the toner images have been transferred to the recording paper P, the surfaces (peripheral surfaces) of the image carriers 20 are cleaned by the cleaning members 28 so that the image carriers 20 are ready for the next image creation process.

A detachable paper supply cassette 46 is disposed in the lower portion of the body frame 12. The paper supply cassette 46 is configured such that it can be pulled out in the direction opposite to the direction in which the recording paper P is fed and such that it can appropriately supply the recording paper P.

A paper supply roller pair 48 that feeds the recording paper P one sheet at a time from the paper supply cassette 46 is disposed in the vicinity of the front end portion of the paper supply cassette 46. The recording paper P fed from the paper supply roller pair 48 is fed at a predetermined timing by a registration roller pair 49 to a suction/conveyance surface of the conveyor belt 34 and conveyed to positions where the toner images of the respective colors are transferred.

Figure 3:
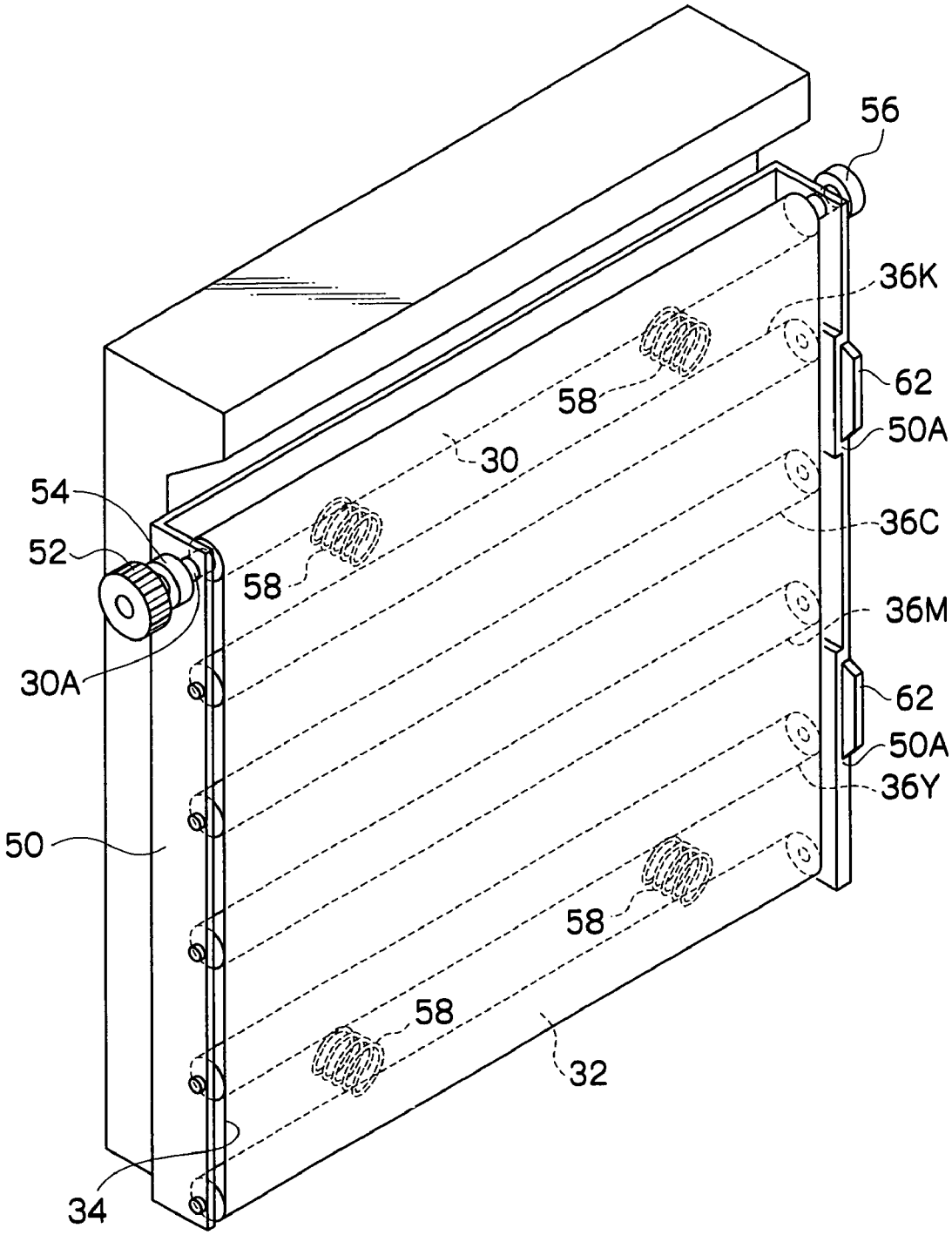
FIG. 3 is a schematic perspective view of the conveyance unit.

Next, the conveyance unit 18, which is detachably attached to the cover 14 in the image forming apparatus 10 having the above-described configuration, will be described in greater detail. As shown in FIG. 3, the conveyance unit 18 includes a substantially rectangular, frame-like casing 50. The drive roller 30 is rotatably axially supported on one end portion (upper end portion) of the casing 50, and the driven roller 32 is rotatably axially supported on the other end portion (lower end portion) of the casing 50. The conveyor belt 34, which is configured to electrostatically suck the recording paper P, is wound around/stretched across the drive roller 30 and the driven roller 32.

The transfer rollers 36Y to 36K are disposed at predetermined intervals per color between the drive roller 30 and the driven roller 32 at the inner surface side of the conveyor belt 34. The transfer rollers 36Y to 36K are also rotatably axially supported on the casing 50. The transfer rollers 36Y to 36K are configured such that when the cover 14 is closed, they contact the image carriers 20Y to 20K with a predetermined pressure so that the conveyor belt 34 is sandwiched therebetween, and rotate following the travel of the conveyor belt 34.

A gear 52 for transmitting rotational power to the drive roller 30 is fixedly attached to one end portion of a rotating shaft 30A of the drive roller 30 protruding outward from the casing 50. An annular member 54 is placed around the rotating shaft 30A at the outer side of the casing 50 and at the inner side of the gear 52. Similarly, an annular member 56 is placed around the other end portion side of the rotating shaft 30A protruding outward from the casing 50.

Figure 4:
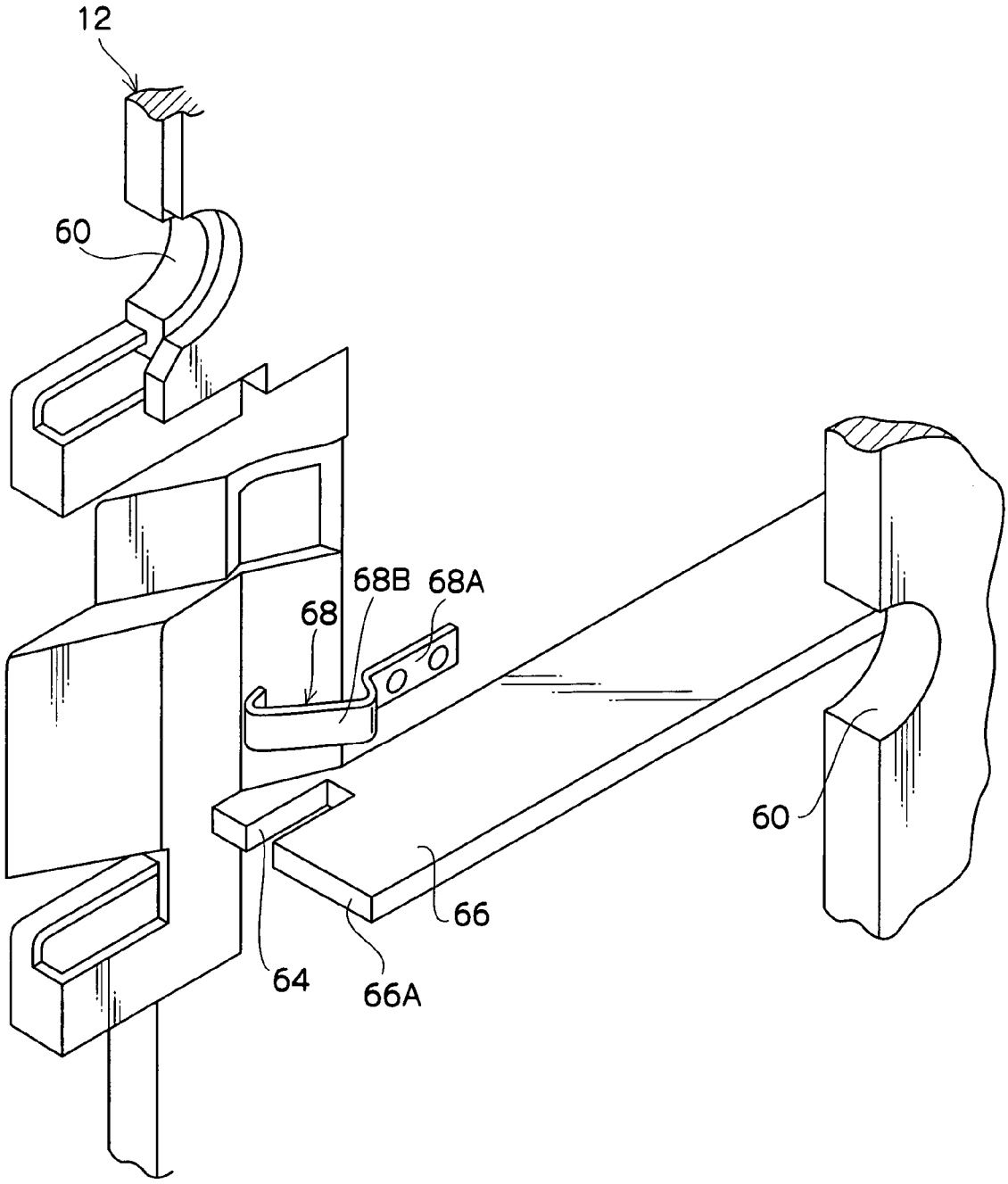
FIG. 4 is a partially enlarged schematic perspective view of the body frame.

As shown in FIGS. 2 and 4, recessed portions 60 (first regulating portions) that are substantially U-shaped when seen in side view and against which the annular members 54 and 56 abut are formed as a left and right pair at predetermined positions in the upper portion of the body frame 12. As shown in FIG. 3, plural (four in the example shown in the drawing) coil springs 58 (first urging portions) abut against the outer side (cover 14 side) of the casing 50, such that when the cover 14 is closed, the coil springs 58 push the conveyance unit 18 toward the body frame 12 with a predetermined pressure.

Consequently, the annular members 54 and 56 reliably abut against the recessed portions 60, whereby the movement in the radial direction (direction orthogonal to the axial direction) of the drive roller 30 is regulated, and the position of the conveyance unit 18 with respect to the body frame 12, i.e., the position of the transfer rollers 36 (conveyor belt 34) with respect to the image carriers 20, is regulated to an appropriate position. The shape of the recessed portions 60 is not limited to the substantial U-shape shown in the drawings and may also be a substantial V-shape, for example.

The edge portion of the casing 50 at the side, where the annular member 56 is attached (the other end portion side where the gear 52 is not disposed), is thickly formed at least between the transfer roller 36Y and the transfer roller 36M and between the transfer roller 36C and the transfer roller 36K, and tabular protruding portions 62 (engagement portions) are disposed, such that they protrude a predetermined height in the radial direction (direction orthogonal to the axial direction) of the drive roller 30 and the driven roller 32, on the thick edge portion.

Here, it is preferable to regulate the position at both the upper and lower end portions in order to appropriately regulate the position of the conveyance unit 18 with respect to the body frame 12. Consequently, in this case, it is preferable to dispose at least one of the protruding portions 62 at a position as much as possible away from the recessed portions 60 in order to regulate the position in the radial direction (direction orthogonal to the axial direction) with the recessed portions 60. Thus, as is illustrated, one of the protruding portions 62 is protrudingly disposed between the transfer roller 36Y furthest from the drive roller 30 (recessed portions 60) and the transfer roller 36M second furthest from the drive roller 30.

Support portions 66 configured to support and accommodate the development units 16Y to 16K from their lower portions at both ends in the axial direction are disposed in the body frame 12. Slit portions 64 (second regulating portions), into which the protruding portions 62 are insertable, are formed, in correspondence to the protruding portions 62, in the support portions 66 between the development unit 16Y and the development unit 16M and between the development unit 16M and the development unit 16C.

Figure 7A:
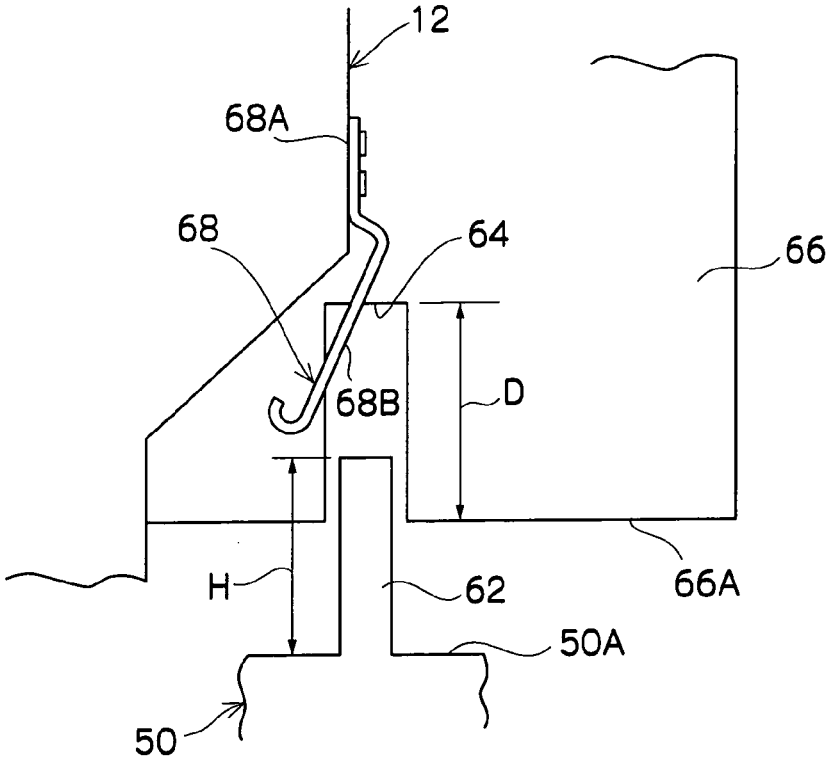
FIGS. 7A and 7B are schematic plan views showing the state of relevant portions when the cover is closed.
Figure 7B:
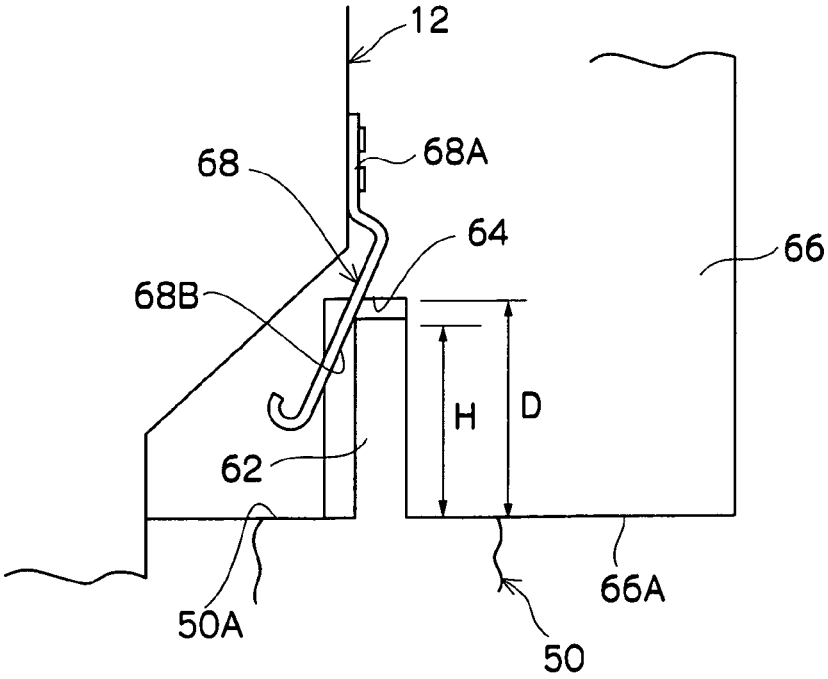

As shown in FIGS. 7A and 7B, the depth D of the slit portions 64 is greater than the height H to which the protruding portions 62 protrude (D>H), such that when the cover 14 is closed, end surfaces 66A of the support portions 66, in which the slit portions 64 are formed, abut against engagement surfaces 50A of the thick portions of the casing 50 where the protruding portions 62 are protrudingly disposed.

Thus, the movement of the conveyance unit 18 in the radial direction (direction orthogonal to the axial direction) of the drive roller 30 is further regulated, and the position of the conveyance unit 18 with respect to the body frame 12, i.e., the position of the transfer rollers 36 (conveyor belt 34) with respect to the image carriers 20, is regulated to a more appropriate position.

Also, as shown in FIG. 4, plate springs 68 (second urging portions) are disposed above (or below) the support portions 66, and base portions 68A of the plate springs 68 are fixedly attached to the body frame 12. As shown in FIGS. 5, 6, 7A and 7B, when the protruding portions 62 are inserted into the slit portions 64, the outer surfaces (or inner surfaces) of the protruding portions 62 are pushed in the axial direction of the drive roller 30 (the driven roller 32) by acting portions 68B of the plate springs 68.

Thus, because the conveyance unit 18 is pushed with a predetermined pressure toward one axial-direction end portion side (or the other width-direction end portion side) of the drive roller 30 (the driven roller 32), the movement of the conveyance unit 18 (conveyor belt 34) in the axial direction of the drive roller 30 (the driven roller 32) is regulated such that positional displacement of the conveyance unit 18 (conveyor belt 34) disposed on the cover 14 does not occur even when the user mistakenly pushes the cover 14 or when something collides with the cover 14 during printing, for example.

The second urging portions are not limited to the plate springs 68 shown in the drawings, and may also be torsion springs (not shown), for example. Also, a similar effect can be obtained in a configuration where something similar to the protruding portions 62 is formed on the body frame 12 and where something similar to the slit portions 64 is formed in the casing 50.

Figure 8:
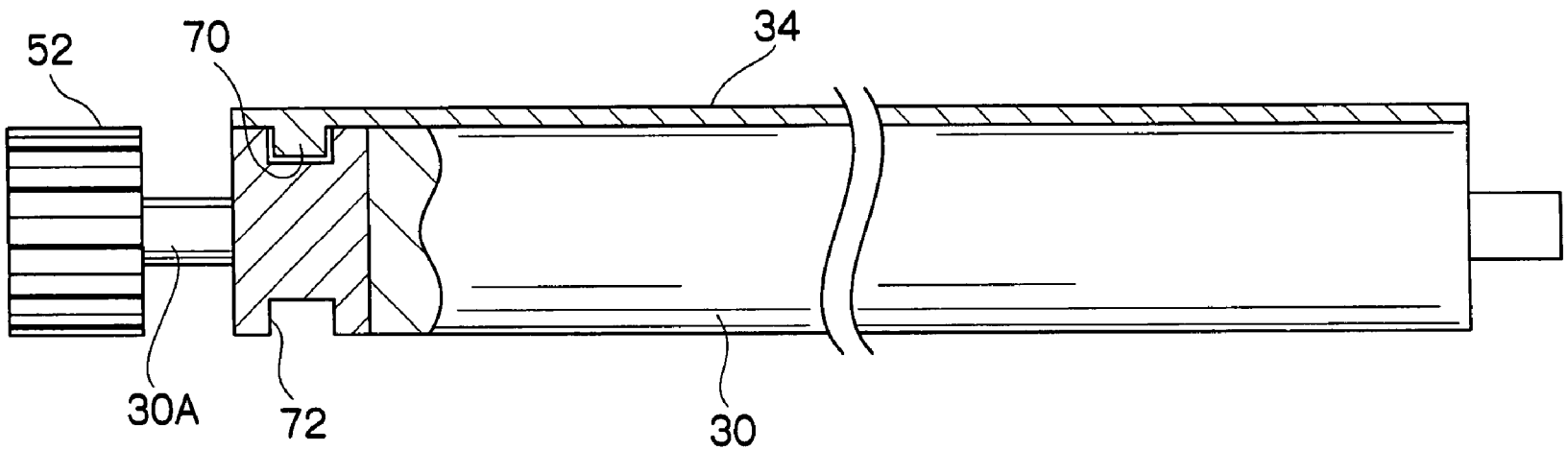
FIG. 8 is a partial broken schematic plan view of the conveyance unit.

As shown in FIG. 8 (the annular members 54 and 56 are omitted from FIG. 8), a rib-like protrusion 70 is disposed, such that it linearly protrudes along the traveling direction of the conveyor belt 34, on the inner surface (undersurface) of one width-direction end portion side (the side where the gear 52 is attached) of the conveyor belt 34. The rib-like protrusion 70 is configured to engage with (be inserted into) a recessed groove 72 that is formed in one end portion side (the side where the gear 52 is attached) of the drive roller 30 and the driven roller 32. Consequently, it is difficult for the conveyor belt 34 to meander in the axial direction of the drive roller 30 and the driven roller 32.

Thus, because the rib-like protrusion 70 becomes an obstacle when the conveyor belt 34 is stretched across the drive roller 30 and the driven roller 32, the conveyor belt 34 is wound around the rollers 30 and 32 from the side where the recessed groove 72 is formed. For this reason, it is preferable for the protruding portions 62 to be protrudingly disposed in the other end portion side where the recessed groove 72 is not formed (the side where the gear 52 is not attached), whereby it can be ensured that the incorporability (winding/stretching) of the conveyor belt 34 with respect to the rollers 30 and 32 is not compromised (so that the conveyor belt 34 can be incorporated without the protruding portions 62 becoming an obstacle).

Next, the operation of the image forming apparatus 10 having the above configuration will be described. First, the recording paper P is removed one sheet at a time by the paper supply roller pair 48 from the paper supply cassette 46, and fed at a predetermined timing onto the conveyor belt 34 by the registration roller pair 49. The recording paper P fed onto the conveyor belt 34 is electrostatically sucked by the conveyor belt 34 and conveyed to the image carriers 20Y to 20K of the respective colors.

In the development units 16, first, the surfaces (peripheral surfaces) of the image carriers 20 are uniformly charged by the charge rollers 22. Then, the surfaces (peripheral surfaces) of the image carriers 20 are scanned with laser light (image light) from the optical box 24, and electrostatic latent images based on image data are formed on the surfaces (peripheral surfaces) of the image carriers 20. Thereafter, toner images are transferred onto the image carriers 20 by the development rollers 26, and visible images are formed on the surfaces (peripheral surfaces) of the image carriers 20.

When the visible images are formed on the surfaces (peripheral surfaces) of the image carriers 20 in this manner, the toner images (unfixed images) on the surfaces of the image carriers 20 are transferred by the image carriers 20 and the transfer rollers 36 onto the recording paper P, which is sucked and conveyed by the conveyor belt 34. This is conducted in the order of yellow (Y), magenta (M), cyan (C) and black (K). When a full-color toner image (unfixed image) has been transferred onto the recording paper P, the recording paper P is conveyed by the conveyor belt 34 to the fixing device 38.

The unfixed toner image transferred onto the recording paper P conveyed to the fixing device 38 is heated and pressured by the heating roller 40 and the pressure roller 42 to be fixed. Then, the recording paper P, on which the toner image has been fixed by the fixing device 38, is discharged onto the paper discharge tray 44. After the toner images have been transferred to the recording paper P, the surfaces (peripheral surfaces) of the image carriers 20 are cleaned by the cleaning members 28 so that the image carriers 20 are ready for the next image creation process.

Here, when the recording paper P jams or at the time of maintenance (toner replenishment) of the development units 16, the cover 14 is pivoted in the direction where it separates from the body frame 12 to open the development units 16 (the image carriers 20). Then, after predetermined work is done, the cover 14 is pivoted toward the body frame 12 to close the development units 16 (the image carriers 20).

At this time, the annular members 54 and 56 placed over both ends of the rotating shaft 30A of the drive roller 30 protruding outward from the casing 50 are caused to abut with a predetermined pressure against the recessed portions 60 formed in the body frame 12 due to the urging force of the coil springs 58 abutting against the outer surface side (cover 14 side) of the casing 50.

Also, the protruding portions 62 protrudingly disposed on the one edge portion of the casing 50 are inserted into the slit portions 64 formed in the body frame 12, and the end surfaces 66A of the support portions 66 in which the slit portions 64 are formed abut against the engagement surface 50A of the casing 50. Thus, the positions of the conveyor belt 34 (transfer rollers 36) and the image carriers 20 are regulated to appropriate positions.

Also, the plate springs 68 attached to the body frame 12 push the outer surfaces of the protruding portions 62. Thus, the conveyance unit 18 is urged toward one width-direction end portion side of the conveyor belt 34 (one axial-direction end portion side of the drive roller 30 and the driven roller 32). In other words, the movement of the conveyance unit 18 is regulated not only in the radial direction (direction orthogonal to the axial direction) of the drive roller 32 but also in the axial direction of the drive roller 30 and the driven roller 32.

Consequently, even if something collides with the cover 14 or the cover 14 is pushed, for example, the position of the conveyor belt 34 of the conveyance unit 18 disposed on the cover 14 can be effectively prevented from being displaced in the main scanning direction (the axial direction) with respect to the development units 16 (the image carriers 20). Thus, color registration in the main scanning direction (the axial direction) can be improved when printing in full color. This becomes particularly effective when the recording paper P is a type of thick paper.

Also, at least one of the slit portions 64 into which the protruding portions 62 are inserted is formed such that it is positioned between the image carrier 20Y furthest from the recessed portions 60, against which the annular members 54 and 56 placed around the rotating shaft 30A of the drive roller 30 abut, and the image carrier 20M second furthest from the recessed portions 60. Consequently, the position of the conveyance unit 18 can be regulated at both its upper and lower end portions by the combination with the recessed portions 60. In other words, the position of the conveyance unit 18 can be appropriately regulated.

Also, because the positions where the slit portions 64 are formed are in the support portions 66 between the image carrier 20Y (the development unit 16Y) and the image carrier 20M (the development unit 16M) and between the image carrier 20C (the development unit 16C) and the image carrier 20K (the development unit 16K), the dead space in the body frame 12 can be effectively utilized.

And because the positions at which the protruding portions 62 are protrudingly disposed are also on the edge portion of the casing 50 positioned between the transfer roller 36Y and the transfer roller 36M and between the transfer roller 36C and the transfer roller 36K, the dead space in the casing 50 with respect to the body frame 12 when the cover 14 is closed can be effectively utilized. Consequently, there are no drawbacks such as excessive space for forming the protruding portions 62 and the slit portions 64, and the overall image forming apparatus 10 can be made compact.

Figure 9:
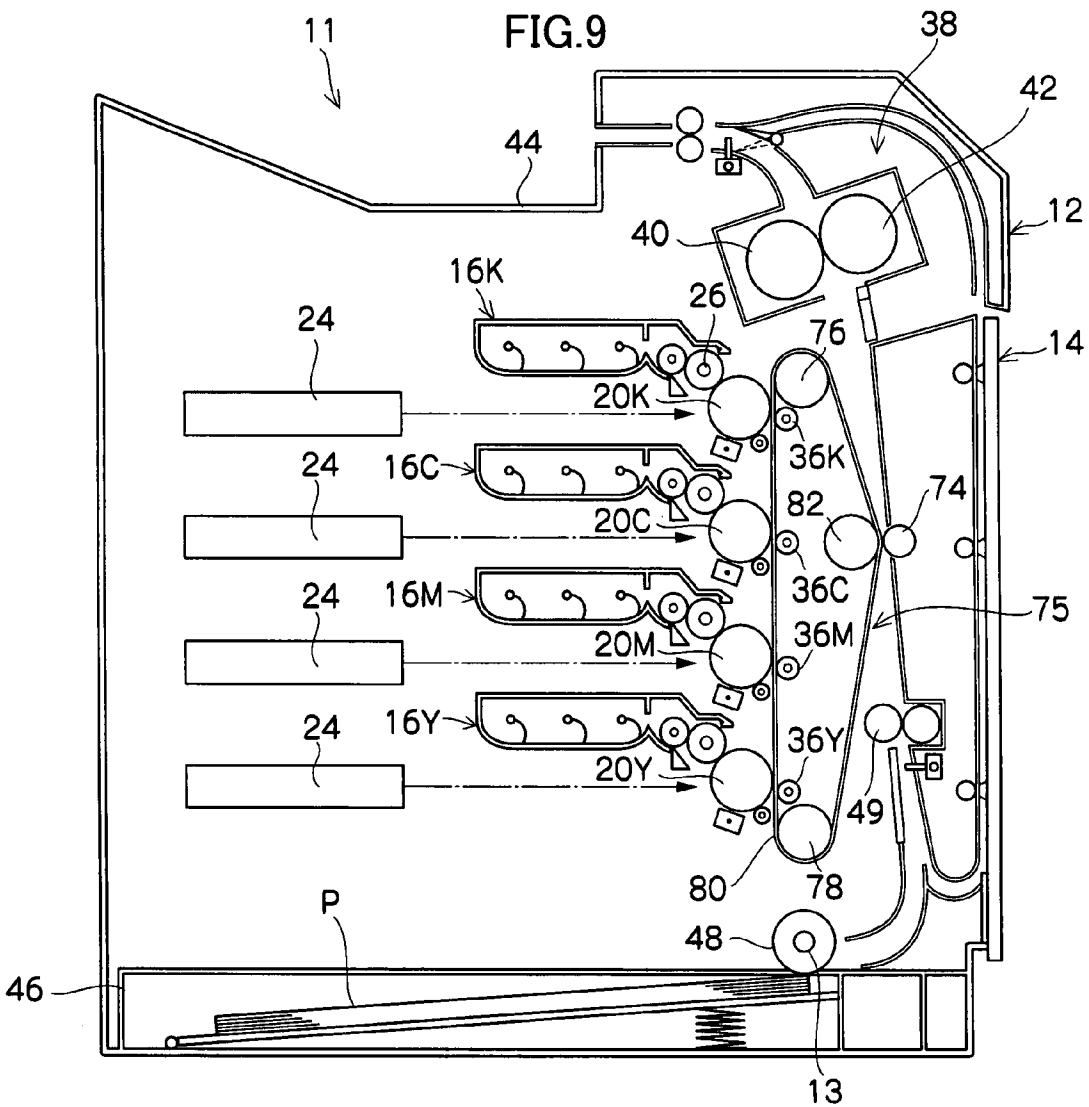
FIG. 9 is a schematic side view showing the configuration of an image forming apparatus disposed with an intermediate transfer belt.

Next, a modified example of the image forming apparatus pertaining to the invention will be described. FIG. 9 shows an image forming apparatus 11 that is different from the image forming apparatus 10 in that an intermediate transfer unit 75 is attached to the cover 14. Consequently, the same reference numerals will be given to portions having the same functions as those of the image forming apparatus 10, and detailed description of those portions will be omitted.

Figure 5:
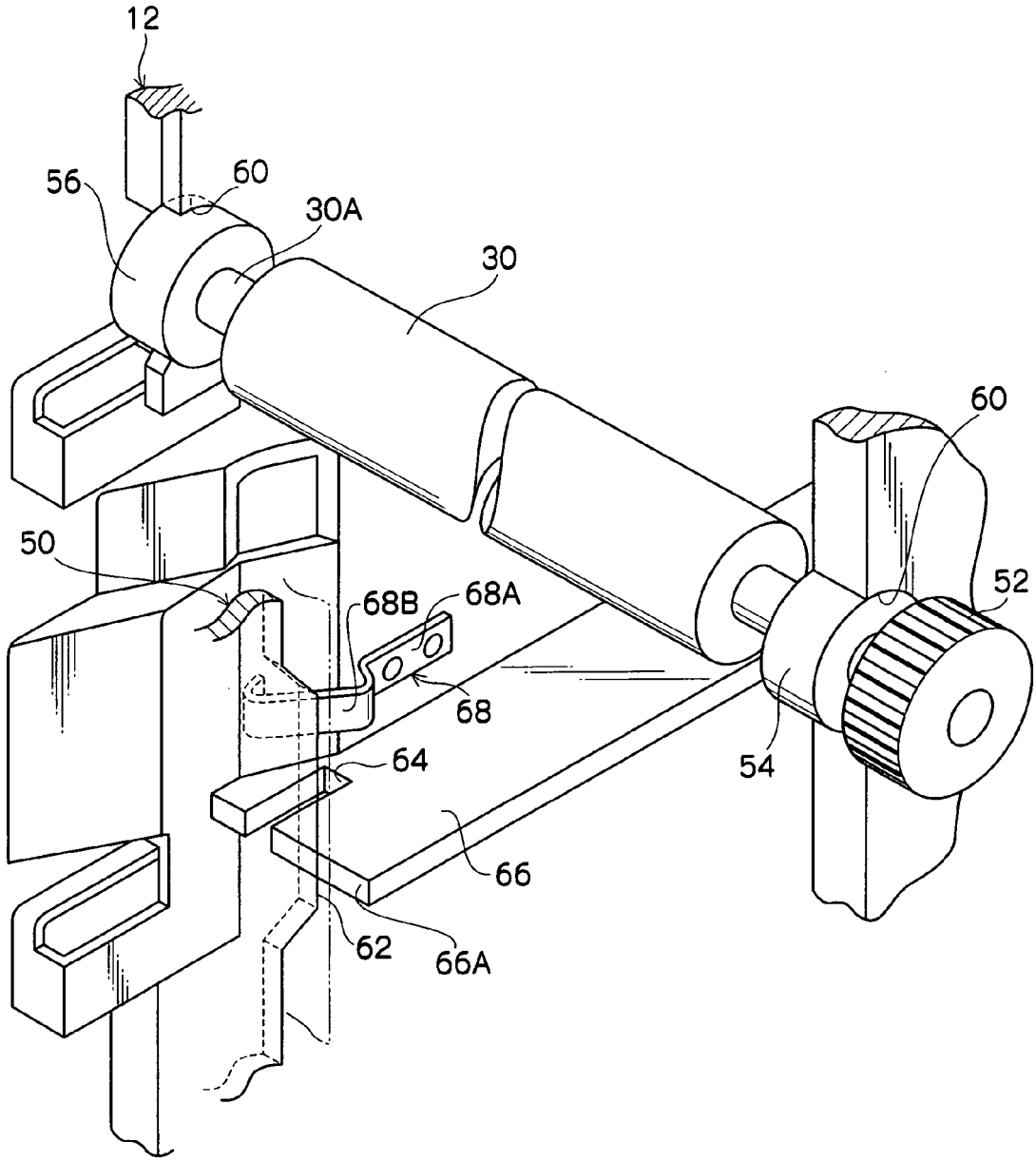
FIG. 5 is a schematic perspective view showing the state of relevant portions when the cover is closed.
Figure 6:
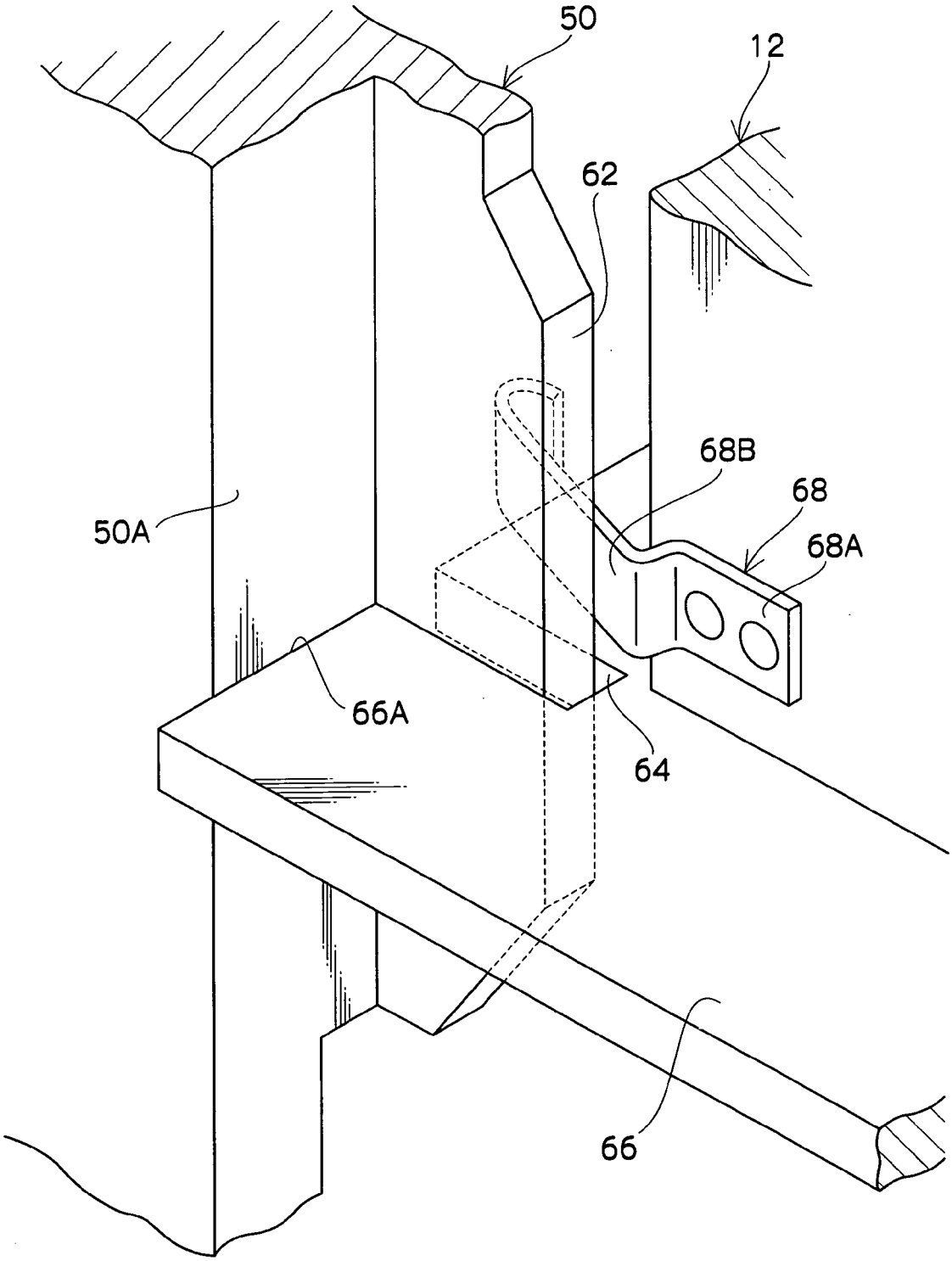
FIG. 6 is a schematic perspective view showing the state of relevant portions when the cover is closed.

As shown in FIG. 9, the intermediate transfer unit 75 is detachably attached to the cover 14, and the cover 14 is pivotably attached to the body frame 12 via a hinge portion 13 formed coaxially with the paper supply roller pair 48. An intermediate transfer belt 80 is stretched across a drive roller 76 and a driven roller 78, and a tension roller 82 is disposed at an appropriate position between the drive roller 76 and the driven roller 78. In an exemplary embodiment, annular members are placed around a rotating shaft of the driver roll 76 in the same manner as shown in FIG. 5.

A backup roller 74 contacts the intermediate transfer belt 80, which is pushed by the tension roller 82. The transfer rollers 36Y to 36K of the respective colors are disposed at appropriate positions between the drive roller 76 and the driven roller 78 opposite from the tension roller 82.

Consequently, the toner images (unfixed images) transferred onto the intermediate transfer belt 80 by the image carriers 20Y to 20K and the transfer rollers 36Y and 36K of the respective colors are transferred onto the recording paper P at the site where the backup roller 74 and the intermediate transfer belt 80 pushed by the tension roller 82 are brought into contact with each other. The recording paper P to which the toner images have been transferred is conveyed to the fixing device 38, where the toner images are fixed by the fixing device 38.

In the image forming apparatus 11 having this configuration, the position of the intermediate transfer unit 75 in the radial direction (direction orthogonal to the axial direction) and in the axial direction of the drive roller 76 is appropriately regulated in the same manner as described above. Thus, the position of the intermediate transfer belt 80 (the transfer rollers 36) with respect to the image carriers 20 is regulated to an appropriate position, and positional displacement of the intermediate transfer unit 75 (the intermediate transfer belt 80) in the main scanning direction (the axial direction) is effectively suppressed.

The present invention is not limited to the embodiment described above and can be modified in various ways.

For example, an image forming apparatus of a third aspect of the invention according to the first aspect further including a first urging portion that urges the conveyance unit in the direction orthogonal to the axial direction of the drive roller when the cover pivots toward the body frame to close off the image carrier, and a second urging portion that urges the conveyance unit in the axial direction of the drive roller when the cover pivots toward the body frame to close off the image carrier.

According to the third aspect of the invention, the position of the conveyance unit can be appropriately regulated. Consequently, positional displacement of the conveyance unit does not occur during printing.

An image forming apparatus of a fourth aspect of the invention according to the first aspect further including a first urging portion that urges the intermediate transfer unit in the direction orthogonal to the axial direction of the drive roller when the cover pivots toward the body frame to close off the image carrier, and a second urging portion that urges the intermediate transfer unit in the axial direction of the drive roller when the cover pivots toward the body frame to close off the image carrier.

According to the fourth aspect of the invention, the position of the intermediate transfer unit can be appropriately regulated. Consequently, positional displacement of the intermediate transfer unit does not occur during printing.

An image forming apparatus of a fifth aspect of the invention is, in one of the first to fourth aspects, an end surface of the second regulating portion abuts against the casing when the cover pivots toward the body frame to close off the image carrier.

According to the fifth aspect of the invention, the position of the conveyance unit or the intermediate transfer unit (belt member) with respect to the image carrier can be regulated to an appropriate position.

An image forming apparatus of a sixth aspect of the invention is, in one of the first to fifth aspects, the engagement portion and the second regulating portion are formed as a pair on at least the driven roller.

According to the sixth aspect of the invention, the position of the conveyance unit or the intermediate transfer unit can be regulated at both end sides because the first regulating portion is formed on the drive roller. Consequently, the position of the conveyance unit or the intermediate transfer belt can be effectively regulated with little position regulation.

An image forming apparatus of a seventh aspect of the invention is, in the sixth aspect, the image carrier is plurally disposed in a vertical direction, and the second regulating portion is formed between the image carrier furthest from the drive roller and the image carrier second furthest from the drive roller.

According to the seventh aspect of the invention, the dead space in the body frame can be effectively utilized such that the second regulating portion can be formed. Consequently, the overall image forming apparatus can be made compact. Also, color registration can be improved when printing in full color, because the position of the conveyance unit or the intermediate transfer unit can be appropriately regulated.

An image forming apparatus of an eighth aspect of the invention is, in one of the first to seventh aspects, the engagement portion is formed on an edge portion of the casing.

According to the eighth aspect of the invention, the dead space casing with respect to the body frame can be effectively utilized such that the engagement portion can be formed. Consequently, the overall image forming apparatus can be made compact.

An image forming apparatus of a ninth aspect of the invention is, in the eighth aspect, a protrusion is disposed, such that it protrudes along the traveling direction of the belt member, on the inner surface of one width-direction end portion side of the belt member, and the engagement portion is formed on the edge portion of the casing at the other width-direction end portion side of the belt member.

According to the ninth aspect of the invention, when the belt member is to be wound around/stretched across the drive roller and the driven roller, it is wound/stretched from the side where the protrusion is not disposed, but because the engagement portion is not formed at the side where the belt member is wound/stretched, it can be ensured that the incorporability of the belt member with respect to the rollers is not compromised.

What is claimed is:

1. An image forming apparatus comprising:

a conveyance unit including a belt member, which is stretched across at least a drive roller and a driven roller and conveys a recording medium, and a casing that axially supports the drive roller and the driven roller;

a body frame disposed with an image carrier for transferring an image to the recording medium, the image being formed on the image carrier by a development unit; and a cover to which the conveyance unit is attached, is pivotably attached to the body frame, and opens/closes off the image carrier, wherein a first regulating portion is formed on the body frame, an annular member placed on a shaft portion of the drive roller abutting against the first regulating portion when the cover pivots toward the body frame to close off the image carrier, and a second regulating portion is formed on the body frame, the second regulating portion engages an engagement portion formed in the casing in a direction orthogonal to an axial direction of the drive roller.

2. An image forming apparatus comprising:

an intermediate transfer unit including a belt member, which is stretched across at least a drive roller and a driven roller and onto which an image is transferred from an image carrier, and a casing that axially supports the drive roller and the driven roller, the image being formed on the image carrier by a development unit;

a body frame disposed with the image carrier; and a cover to which the intermediate transfer unit is attached, is pivotably attached to the body frame, and opens/closes off the image carrier, wherein a first regulating portion is formed on the body frame, an annular member placed on a shaft portion of the drive roller abutting against the first regulating portion when the cover pivots toward the body frame to close off the image carrier, and a second regulating portion is formed on the body frame, the second regulating portion engages an engagement portion formed in the casing in a direction orthogonal to an axial direction of the drive roller.

3. The image forming apparatus of claim 1, further comprising a first urging portion that urges the conveyance unit in the direction orthogonal to the axial direction of the drive roller when the cover pivots toward the body frame to close off the image carrier, and a second urging portion that urges the conveyance unit in the axial direction of the drive roller when the cover pivots toward the body frame to close off the image carrier.

4. The image forming apparatus of claim 2, further comprising a first urging portion that urges the intermediate transfer unit in the direction orthogonal to the axial direction of the drive roller when the cover pivots toward the body frame to close off the image carrier, and a second urging portion that urges the intermediate transfer unit in the axial direction of the drive roller when the cover pivots toward the body frame to close off the image carrier.

5. The image forming apparatus of claim 1, wherein an end surface of the second regulating portion abuts against the casing when the cover pivots toward the body frame to close off the image carrier.

6. The image forming apparatus of claim 2, wherein an end surface of the second regulating portion abuts against the casing when the cover pivots toward the body frame to close off the image carrier.

7. The image forming apparatus of claim 3, wherein an end surface of the second regulating portion abuts against the casing when the cover pivots toward the body frame to close off the image carrier.

8. The image forming apparatus of claim 4, wherein an end surface of the second regulating portion abuts against the casing when the cover pivots toward the body frame to close off the image carrier.

9. The image forming apparatus of claim 1, wherein the engagement portion and the second regulating portion are formed as a pair on at least the driven roller.

10. The image forming apparatus of claim 2, wherein the engagement portion and the second regulating portion are formed as a pair on at least the driven roller.

11. The image forming apparatus of claim 9, wherein the image carrier is plurally disposed in a vertical direction, and the second regulating portion is formed between the image carrier furthest from the drive roller and the image carrier second furthest from the drive roller.

12. The image forming apparatus of claim 10, wherein the image carrier is plurally disposed in a vertical direction, and the second regulating portion is formed between the image carrier furthest from the drive roller and the image carrier second furthest from the drive roller.

13. The image forming apparatus of claim 1, wherein the engagement portion is formed on an edge portion of the casing.

14. The image forming apparatus of claim 2, wherein the engagement portion is formed on an edge portion of the casing.

15. The image forming apparatus of claim 13, wherein a protrusion is disposed, such that it protrudes along the traveling direction of the belt member, on the inner surface of one width-direction end portion side of the belt member, and the engagement portion is formed on the edge portion of the casing at the other width-direction end portion side of the belt member.

16. The image forming apparatus of claim 14, wherein a protrusion is disposed, such that it protrudes along the traveling direction of the belt member, on the inner surface of one width-direction end portion side of the belt member, and the engagement portion is formed on the edge portion of the casing at the other width-direction end portion side of the belt member.

17. The image forming apparatus of claim 1, wherein the first regulating portion is a substantially U-shaped recessed portion.

18. The image forming apparatus of claim 2, wherein the first regulating portion is a substantially U-shaped recessed portion.

19. The image forming apparatus of claim 1, wherein the engagement portion is a tabular protruding portion and the regulating portions are slits.

20. The image forming apparatus of claim 2, wherein the engagement portion is a tabular protruding portion and the regulating portions are slits.

21. An apparatus comprising:

a transporting unit including a belt member, which is stretched across at least a drive roller and a driven roller and transports a recording medium, and a casing that axially supports the drive roller and the driven roller;

a body frame disposed with an image carrier for transferring an image to the recording medium; and a cover to which the transporting unit is attached, is pivotably attached to the body frame, and opens/closes off the image carrier, wherein a first regulating portion is formed on the body frame, an annular member placed on a shaft portion of the drive roller abutting against the first regulating portion when the cover pivots toward the body frame to close off the image carrier, and a second regulating portion is formed on the body frame, the second regulating portion that engages an engagement portion formed in the casing in a direction orthogonal to an axial direction of the drive roller.

* * * * *